United States Patent [19]

Busai et al.

[11] Patent Number: 5,073,742

[45] Date of Patent: Dec. 17, 1991

[54] INCANDESCENT LAMP WITH MOUNTING ASSEMBLY

[75] Inventors: Gyula Busai; Györgyi Végh; Zoltán Losonczi; Ákos Ocsovai; István Pozsonyi; György Szabó, all of Budapest; György Vajó, Göd, all of Hungary

[73] Assignee: Tungsram Részvénytársaság, Budapest, Hungary

[21] Appl. No.: 482,847

[22] Filed: Feb. 22, 1990

[51] Int. Cl.[5] ..... H01J 5/50

[52] U.S. Cl. ..... 313/318; 313/315

[58] Field of Search ..... 313/318, 113, 315, 528; 362/61, 296, 341

[56] References Cited

U.S. PATENT DOCUMENTS

| | | | |
|---|---|---|---|
| 4,122,367 | 10/1978 | Esklavor et al. | 313/318 |
| 4,470,104 | 9/1984 | Cox | 313/318 |
| 4,567,397 | 1/1986 | Wilhelm et al. | 313/318 |

*Primary Examiner*—Donald J. Yusko
*Assistant Examiner*—Michael Horabik
*Attorney, Agent, or Firm*—Spencer & Frank

[57] ABSTRACT

In an incandescent lamp, comprising a translucent envelope (2) having flattened end (3) of rectangular cross-section, a base element (5) surrounding the flattened end part (3) and having rectangular cross-section, two current lead-ins (7*a*, 7*b*) connected with an incandescent body (4) arranged within the envelope (2) and with the base element (5) and thereby with a connecting cable (8), a centering plate (6) with a rectangular opening for receiving the base element (5), wherein the centering plate (6) is made with at least one flange element (10) arranged on the side of the centering plate (6) not facing the envelope (2), the base element (5) being made with thinner plate than the centering plate (6), a locating body (9) stepwisely shaped for receiving the flange element (10) is applied, the locating body (9) made with thinner wall than the centering plate (6) is fixed on the base element (5), has an edge (14) separated from the base element (5) by a gap, wherein the edge (14) of the locating body (9) covers at least partly the at least one flange element (10) of the centering plate (6), the flange element (10) of the centering plate (6) is between the base element (5) and the locating body (9), further the flange element (10) of the centering plate (6) and the locating body (9) are connected by a thermal method of joining.

9 Claims, 1 Drawing Sheet

INCANDESCENT LAMP WITH MOUNTING ASSEMBLY

FIELD OF THE INVENTION

The present invention refers to an incandescent lamp, especially for use in the headlight systems of motor cars, comprising a translucent envelope having flattened end part made with substantially rectangular cross-section, a base element surrounding the flattened end part and having substantially rectangular cross-section, two current lead-ins one of them connected with an incandescent body arranged within the envelope, the other with the base element and thereby with a connecting cable and a centering plate with a rectangular opening for receiving the base element from one side facing the envelope, wherein the centering plate is made with at least one flange element arranged on the reverse side of the centering plate and the base element is thinner than the centering plate. The incandescent lamp as proposed is preferably capable of facilitating the process of optical adjusting the incandescent body.

BACKGROUND OF THE INVENTION

The electric incandescent lamps applied in headlights of vehicles and in projector systems have to be arranged with high accuracy in an optical system determined by a basic plane. For carrying out this operation the incandescent lamp is equipped with a base element and fixed thereby in an optical adjusting arrangement. The base element is then slided in the arrangement in order to ensure the required position of the incandescent body which should lie in the focus plane of the body of the headlight or projector system. This is generally made by applying a centering plate made in form of a disc which is joined with the base element after completing the adjusting operation. The connection is generally ensured by brazing or welding. The disadvantage of the brazing process is its long time and therefore care should be done for preventing the high thermal load of the incandescent lamp. The general way of development is to exclude brazing and to apply a welding process which results in shortening the time of operation for joining the base element and the centering plate.

In the known incandescent lamp arrangements the centering plate is relativelly thick, the base element is thinner than the centering plate which is equipped with a flange element connecting the centering plate and the base element. The flange is protruding from the surface of the centering plate at the base element. If the centering plate and the base element should be joined by point welding, the flange element of the thick centering plate is pressed to the thin base element which can suffer deformation under the influence of this pressure.

The German patent document DE-OS 26.05.433 discloses an electric incandescent lamp having a base element made with hooked flange elements on its opposite longitudinal sides. The flange elements are arranged with ends lying in a gap between the centering plate and the base element and in this position it is possible to join the centering plate by its flange element with the base element. This construction is advantageous for welding but linked with difficult problems when the optical adjusting operation should be carried out. The hooked flange elements protrude from the surface of the base element and they end behind the edge of the opening of the centering plate. In this way relatively big connecting surfaces are ensured and this fact limits the possibility of precise translating necessary when the incandescent body of the lamp should be adjusted.

OBJECT OF THE INVENTION

The present invention is intended for creating an incandescent body wherein the centering plate required for the optical adjusting operations can be joined with the base element of the lamp by a simple welding operation, the incandescent body may be translated in a wide range when adjusting is necessary and the position ensured by adjusting can be fixed by a simple quickly realized welding step resulting in a fixed position of high strength.

The invention is based on the recognition that the centering plate and the base element of the incandescent body should be linked with a locating body of stepwise construction ensuring a reliable guidance rendering possible all translations necessary during the optical adjusting process and facilitating the welding step required for joining the centering plate and the base element.

Hence, the invention proposes an incandescent lamp, comprising a translucent envelope having flattened end part made with substantially rectangular cross-section, a base element surrounding the flattened end part and having substantially rectangular cross-section, two current lead-ins, one of them connected with an incandescent body arranged within the envelope, the other with the base element and thereby with a connecting cable, a centering plate with a rectangular opening for receiving the base element from one side facing the envelope, wherein the centering plate is made with at least one flange element arranged on the reverse side of the centering plate and the base element is advantageously made with thinner plate than the centering plate, with the novel features of comprising a locating body facing the flange element, the locating body having an upper part for receiving the at least one flange element and a lower part shaped in U form for receiving the base element, the lower and upper parts constituting an integral unit, wherein the base element is preferably made with thinner wall than the centering plate, the locating body has in the upper part an edge covering at least partly the at least one flange element of the centering plate, the flange element of the centering plate intrudes into a gap between the base element and the locating body, further the flange element of the centering plate and the locating body is connected with one another by a thermal method of joining, especially by welding.

In an especially advantageous embodiment of the incandescent lamp realized according to the present invention nipples having cylindric or hemispherical shape are present in the gap for ensuring guidance of the flange elements and the centering plate when carrying out optical adjusting of the incandescent body. Preferably, the nipples are prepared at the edge(s) of the locating body and they are manufactured as protrusions from the inner surface of the locating body. The height of the nipples is rather at most 1 mm.

The locating body of the incandescent lamp of the invention is especially advantageous because it is capable of ensuring auxiliary fixation and/or strengthening of the connecting cable.

The essence of the invention lies in the locating body which is an element for receiving both the base of the incandescent lamp and the flange protruding from the centering plate. It comprises two stepwise narrowing walls facing one another and forming an integral unit with upper and lower parts limited from two sides by substantially parallel straigth plane plates, the lower part having walls connected one with another. The positive effect of the invention follows basically from this element. The locating body renders it possible to move, translate the incandescent lamp and thereby the incandescent body (the filament of the lamp) in a required range and it assures the further advantage that the connecting cable can be fixed and/or strengthened with higher reliability than in the known constructions by applying a bended section in a plate connecting the walls of the lower part. The thin surface parts of the locating body cover the flange elements of the centering plate from outside and this creates the conditions of facilitating the welding process: the required fixation can be made by simple point welding.

BRIEF DESCRIPTION OF THE DRAWINGS

The invention will be further described by way of example only by presenting preferred embodiments with reference to the enclosed drawings. In the drawings

DETAILED DESCRIPTION OF THE PREFERRED EMBODIMENTS

Figure 1:
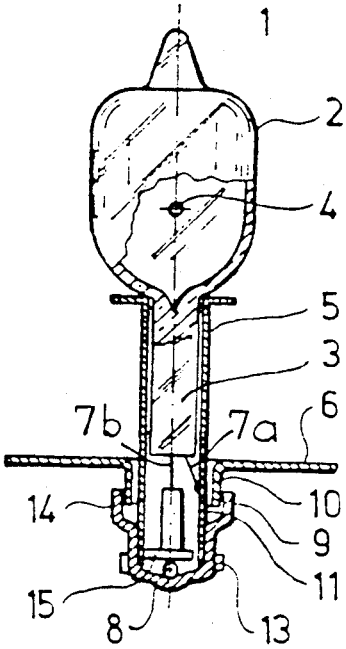
FIG. 1 shows a schematic side view, partly in cross-section of an incandescent lamp built-up according to the invention.
Figure 2:
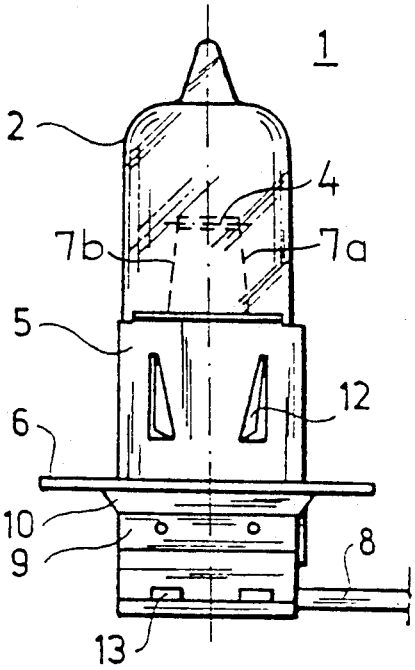
FIG. 2 represents a front view of the incandescent lamp shown in FIG. 1

The invention proposes among other embodiments an incandescent lamp 1 shown in FIGS. 1 and 2 which is a headlight lamp applied especially in motor vehicles (cars). Hence, an incandescent lamp 1 is proposed which is equipped with a translucent envelope 2 made generally of glass. In the inner space of the envelope 2 an incandescent body 4 (filament) manufactured according to the general practice of the lighting industry is arranged. The envelope 2 carries at one end a flattened end part 3 of substantially rectangular cross-section. The flattened end part 3 is surrounded by a base element 5 which is also of substantially rectangular cross-section. The base element 5 is connected with a centering plate 6 generally of disc form and the centering plate 6 is contacted with a locating body 9. The incandescent lamp 1 is equipped with current lead-ins 7*a* and 7*b* coupled with the base element 5 and a connecting cable 8, respectively. A supporting member 15 is arranged at the locating body 9 for protecting the connecting cable 8 from mechanical stresses. The base element 5 may be provided with ears 13 as shown in FIGS. 1 and 2.

The locating body 9 (FIG. 3) forms a stepwise constructed bracket made with upper and lower parts, the upper part having substantially parallel walls having a spacing greater than that between the substantially parallel walls of the lower part. The locating body 9 is manufactured from a relatively thin metal sheet when compared to the centering plate 6 and has an inner surface 22 bearing nipples 24. The nipples 24 are generally cylindrical or hemispherical knobs protruding from the inner surface 22. In the generally U-shaped lower part the side walls are connected by a bottom part having a circularly curved middle section 20.

The flattened end part 3, as it is shown in FIG. 2 is connected with the base element 5. The base element 5 is manufactured from a plate of about 0.2 mm thickness and has two wider and two smaller sides. On the wider sides there are ears 12 (two ears for each side) which are arranged in parallel with the longitudinal axis of the base element 5 and are flanged out from the surface thereof. The ears 12 serve for fixing the base element 5 on the flattened end part 3. The centering plate 6 is made from a metal sheet of 0.8 mm thickness and is prepared with an inner opening of rectangular shape (not specified in the drawings) for receiving the base element 5 from a first side. The opening is at least partly limited laterally by slightly curved flange elements 10 protruding from the reverse side of the centering plate 6. The base element 5 is arranged in this rectangular opening of the centering plate 6 and is contacted with the flange elements 10. The base element 5 is prepared with a closing member 11 reaching the inner space defined by the flange elements 10. The closing member 11 is arranged within the bracket type locating body 9 and lies in a gap between the base element 5 and the locating body 9. In this way the flange elements 10 and an edge 14 of the locating body 9 match one another. The flange elements 10 are curved out from the surface of the centering plate 6. The matched connection doesn't mean fix coupling between the base element 5 and the centering plate 6.

The incandescent lamp of the invention can be applied as follows:

The incandescent lamp 1 as shown in FIGS. 1 and 2 is arranged together with the centering plate 6 matching the base element 5 in an optical apparatus (not shown in the drawings) for adjusting the incandescent body 4. The position of the centering plate 6 and the incandescent body 4 is modified as long as it is necessary for adjusting the required optical conditions of lighting. The nipples 24 on the inner surface 22 of the locating body 9 facilitate the translation (sliding) of the centering plate 6 because it is a surface contact between the nipples 24 and flange elements 10 of the centering plate 6. In this way a relatively long range translation is possible without breaking the connection between the elements to be adjusted. The locating body is mechanically linked with the base element 5 by the means of the ears 13 wherein the flange elements 10 of the centering plate 6 and the edge 14 of the locating body 9 can be joined by applying a point welding process.

Figure 3:
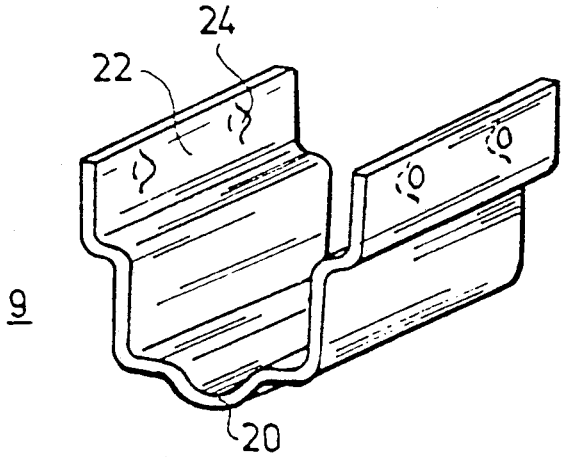
FIG. 3 is a view of a stepwise realized locating body with spherical nipples.

The locating body 9 consists of a metallic plate, e.g. of thickness 0.5 mm and as it is shown in FIG. 3, it consists of upper and lower parts with stepwise changing distance between the opposite walls. The curved middle section 20 connecting the opposite sides of the lower part is very advantageous for fixing the connecting cable 8. The supporting member 15 flanging from the surface of the base element 5 increases the stability, reliability of fixing the connecting cable 8.

The nipples 24 constitute generally hemispherically shaped knobs (small protrusions) on the inner surface 22 of the locating body 9. Their height makes out generally less than 1 mm, it lies preferably in the range about 0.15 mm, i.e. the nipples 24 form small surface elements of the locating body 9. In this way it is possible to ensure that the envelope 2 together with the incandescent body 4 is slidably guided in the inner space of the locating body 9 until the required optical conditions are given.

The locating body 9 is very advantageous in the mass production of the electric incandescent lamps to be applied in headlights of motor vehicles. If necessary, the nipples 24 may not be applied and the flange elements 10 replaced by appropriate surface elements.

The incandescent lamp 1 of the invention can be realized in different manners and the most important feature is that the base element 5 is connected with the stepwise constructed locating body 9, e.g. in the form shown in FIG. 3. The arrangement renders it possible the incandescent lamp to slide in required manner and range and simultaneously to protect the connecting cable against mechanical stresses. An important advantage is that the point welding process can practically not harm the base element of the incandescent lamp.

However, the invention is shown here with reference to a specific embodiment to be applied in the motor industry for preparing headlights, it is generally not intended to be restricted in the scope of protection by the example given above. The essence of the invention is rather to be found in the claims.

What we claim is:

1. An incandescent lamp, comprising a translucent envelope having a flattened end part having a substantially rectangular cross-section, a base element surrounding said flattened end part and having a substantially rectangular cross-section, an incandescent body arranged within said envelope, a connecting cable, a first current lead-in connected to the base element and to the incandescent body, a second current lead-in connected to the connecting cable and to the incandescent body and a centering plate having a rectangular opening for receiving said base element from one side facing said envelope, said centering plate being provided on a reverse side with at least one flange element, the improvement comprising a locating body facing said flange element, said locating body having an upper part for receiving said at least one flange element and a lower part shaped in U form for receiving said base element, said lower and upper parts constituting an integral unit, said locating body having in said upper part an edge covering at least partly said at least one flange element of said centering plate, said flange element of said centering plate intruding into a gap between said base element and said locating body, further said flange element of said centering plate and said locating body being connected with one another by a thermal method of joining.

2. The incandescent lamp according to claim 1, further wherein said locating body and said centering plate are joined by a weld.

3. The incandescent lamp according to claim 1, further wherein said locating body comprises nipples protruding from a surface limiting said gap, said nipples having a cylindrical or hemispherical shape for ensuring guidance of said flange element and said centering plate when carrying out optical adjusting of said incandescent body.

4. The incandescent lamp according to claim 3, further wherein said nipples are arranged on said inner surface of said locating body and are situated along at least one edge thereof.

5. The incandescent lamp according to claim 3, wherein said nipples have a height of 1 mm at the most.

6. The incandescent lamp according to claim 1, wherein said locating body has a curved section at said lower part for securing said connecting cable.

7. The incandescent lamp according to claim 1, wherein said base element is thinner than said centering plate.

8. The incandescent lamp according to claim 1, wherein said locating body has a thinner wall than said centering plate.

9. An incandescent lamp, comprising a translucent envelope having a flattened end part having a substantially rectangular cross-section, a base element surrounding said flattened end part and having a substantially rectangular cross-section, an incandescent body arranged within said envelope, a connecting cable, a first current lead-in connected to the base element and to the incandescent body, a second current lead-in connected to the connecting cable and to the incandescent body and a centering plate having a rectangular opening for receiving said base element from one side facing said envelope, said centering plate being provided on a reverse side with at least one flange element, said base element being thinner than said centering plate, the improvement comprising a locating body facing said flange element, said locating body having an upper part for receiving said at least one flange element and a lower part shaped in U form for receiving said base element, said lower and upper parts constituting an integral unit, said base element having a thinner wall than said centering plate, said locating body having in said upper part an edge covering at least partly said at least one flange element of said centering plate, said flange element of said centering plate intruding into a gap between said base element and said locating body, wherein said flange element of said centering plate and said locating body are connected with one another by a thermal method of joining, and nipples are arranged for protruding from a surface limiting said gap, said nipples having cylindrical or hemispherical shape for ensuring guidance of said flange element and said centering plate when carrying out optical adjusting of said incandescent body.

* * * * *

UNITED STATES PATENT AND TRADEMARK OFFICE

CERTIFICATE OF CORRECTION

PATENT NO. : 5,073,742

DATED : December 17, 1991

INVENTOR(S) : Gyula Busai et al

It is certified that error appears in the above-identified patent and that said Letters Patent is hereby corrected as shown below:

Title Page:
In the heading of the patent document, after line [22], insert

--[30] Foreign Application Priority Data

March 10, 1989 Hungary.....1175/89--.

Signed and Sealed this

Twenty-seventh Day of April, 1993

*Attest:*

MICHAEL K. KIRK

*Attesting Officer*

*Acting Commissioner of Patents and Trademarks*